United States Patent [19]

Jennings, Jr.

[11] Patent Number: 4,664,191

[45] Date of Patent: May 12, 1987

[54] MINIMIZING FORMATION DAMAGE DURING GRAVEL PACK OPERATIONS

[75] Inventor: Alfred R. Jennings, Jr., Plano, Tex.

[73] Assignee: Mobil Oil Corporation, New York, N.Y.

[21] Appl. No.: 769,223

[22] Filed: Aug. 26, 1985

[51] Int. Cl.[4] ..... E21B 43/04

[52] U.S. Cl. ..... 166/276; 166/278

[58] Field of Search ..... 166/276, 278, 281, 290, 166/297

[56] References Cited

U.S. PATENT DOCUMENTS

| | | | |
|---|---|---|---|
| 3,695,355 | 10/1972 | Wood et al. | 166/278 |
| 3,800,847 | 4/1974 | Rike | 166/276 |
| 3,983,941 | 10/1976 | Fitch | 166/276 |
| 4,016,931 | 4/1977 | Cryar, Jr. | 166/276 |
| 4,265,311 | 5/1981 | Ely | 166/271 |
| 4,333,461 | 6/1982 | Muller | 128/284 |
| 4,428,427 | 1/1984 | Friedman | 166/278 |

*Primary Examiner*—Stephen J. Novosad
*Assistant Examiner*—William P. Neuder
*Attorney, Agent, or Firm*—A. J. McKillop; M. G. Gilman; C. A. Malone

[57] ABSTRACT

A method for minimizing formation damage during gravel packing operations in a loosely consolidated hydrocarbonaceous fluid producing formation penetrated by at least one well. Solidifiable chemical blocking agents are used to keep intrusive fluids, e.g. kill fluids, from the hydrocarbonaceous fluid producing interval of said formation during said gravel packing operation.

19 Claims, 2 Drawing Figures

MINIMIZING FORMATION DAMAGE DURING GRAVEL PACK OPERATIONS

FIELD OF THE INVENTION

This invention relates to a method for gravel packing formations using a solidifiable blocking agent in combination with a gravel pack operation to minimize formation damage.

BACKGROUND OF THE INVENTION

Sand consolidation and gravel packing are two near wellbore techniques widely used for controlling the production of sand from producing wells such as oil wells, gas wells and similar boreholes. In many instances, highly porous and fragmentable sand formations surround a wellbore. Under production conditions, the sand is often displaced from its aggregated structure and carried along by the fluid flood operations to a producing well. If the sand flow is allowed to procede unchecked, the producing wellbore soon becomes full of sand, thereby clogging the wellbore and impeding oil production. Furthermore, sand arriving at the surface site of the well erodes the production hardware.

As more and more sand is displaced from its original formation, a region of wash-out cavities surrounding the wellbore region results. As the wash-out zones become more extensive, the integrity of the wellbore is threatened and a danger of the wellbore collapsing exists.

It has therefore been the subject of extensive and intense research by the petroleum industry to develop techniques to minimize or obviate displacement of sand particles into producing well areas and prevent the formation of wash-out cavities surrounding the wellbore. One such general approach suggested by the art is to consolidate the coarse sand structures prior to fluid production. Sand consolidation techniques are aimed at cementing loose sand structures adjacent a wellbore. Such consolidation is effective to prevent breakdown of sand formation and subsequent clogging of producing wells.

In many loosely consolidated or unconsolidated formations, it is not economically or practically feasible to consider sand consolidation techniques. Also, there are many instances where substantial wash-out cavities are either initially present naturally near the wellbore or washed-out cavities form around the wellbore after prolonged use despite previous attempts at sand consolidation.

For these conditions, gravel packing techniques are often used to prevent formation sand production or further erosion and to reestablish the integrity of the wellbore periphery. Gravel packing is a secondary sand consolidation technique involving the introduction of a fluid suspension of exogenous particulate matter downhole, to fill the wash-out cavities or to "squeeze" to pack into the formation in the vicinity of the well. The term gravel is somewhat loosely applied in the art to encompass hard, rigid particulate matter ranging in size from a coarse sand to pebble size material.

Once the placement of sand and gravel has been accomplished, a slotted liner or "screen" placed as part of the production sting helps hold the loose filling material and retard the upstream sand flow through the filler material during production conditions.

Present gravel pack procedures often require a filling of the casing with weighted completion fluid or drilling mud prior to perforating. Thereafter the production casing is perforated via a casing gun with shots placed in a helical arrangement. Substantial amounts of wellbore fluid are often lost as in most instances the wellbore is in an overbalanced condition. If the well is not completely dead following the perforation operation, it is generally "killed" so the perforating tool can be pulled from the borehole. After pulling the perforating tool from the borehole, the production tubing along with a slotted liner is directed into the borehole. As a result of these operations, substantial amounts of expensive workover fluid can be lost during these operations. Because of the density, viscosity and chemical makeup of these workover fluids, damage often occurs to the permeability of a formation. Afterwards, in order to stabilize the sand in the formation, an in-casing gravel pack is generally placed within the wellbore along with additional fluids and chemicals. This results often in additional damage to the permeability of the formation.

Therefore, what is needed is a method for a gravel pack operation which will minimize the permeability damage to the formation caused by workover fluids and chemicals.

SUMMARY OF THE INVENTION

This invention is directed to a method for minimizing formation damage during gravel pack operations in loosely consolidated formations penetrated by at least one well. In the practice of this invention, the casing of said well is filled with an underbalanced completion fluid. Afterwards, a removable packer capable of isolating the space between said casing and which also separates the formation from the downhole well pressure is placed within said well. A first tubing suitable for perforating and stabilizing the flow of fluids into said well is set through said packer. To obtain fluid communication with the formation, said first tubing along with the casing is perforated.

In order to isolate the formation, a blocking agent is placed into said formation via said perforations. The blocking agent is then allowed to solidify while forming a solidified plug within the wellbore.

Subsequently, the first tubing and retrievable packer is removed from said well. After removing said first tubing from the well, a second tubing having a slotted portion therein which is sufficient to contact said perforation is placed within said well.

The solid plug formed by said blocking agent is removed from the wellbore by circulating fluid while running tubing into the well. Thereafter, a gravel pack is placed within said well around said slotted portion of said tubing and within said formation adjacent to said slotted portion of the pipe. Said blocking agent is caused to liquefy in a manner to flow from said formation into said well.

It is therefore an object of this invention to minimize formation damage using a temproary gel plug to isolate a formation wherein a gravel pack is utilized.

It is a still further object of this invention to protect the integrity of a formation which is sensitive to fluid intrusion from chemicals and workover fluids.

It is a yet further object of the present invention to use a temporary gel plug in conjunction with a gravel pack operation in order to prevent sand fines from plugging the pores of a formation and pores near the wellbore.

It is a still yet further object of this invention to increase the production of hydrocarbonaceous fluids from a hydrocarbonaceous fluid producing formation.

DESCRIPTION OF PREFERRED EMBODIMENTS

It is a purpose of this invention to provide a method for minimizing formation damage caused by the introduction of fluids into an unconsolidated formation or reservoir, particularly hydrocarbonaceous bearing ones. Formation damage is minimized by avoiding the introduction of fluids having high densities, high viscosities and fluids which contain high concentrations of solids. In some formations, these fluids may destroy the salinity balance and cause a dislodgement of fines which can lead to a plugging of the pores within the formation.

Figure 2:
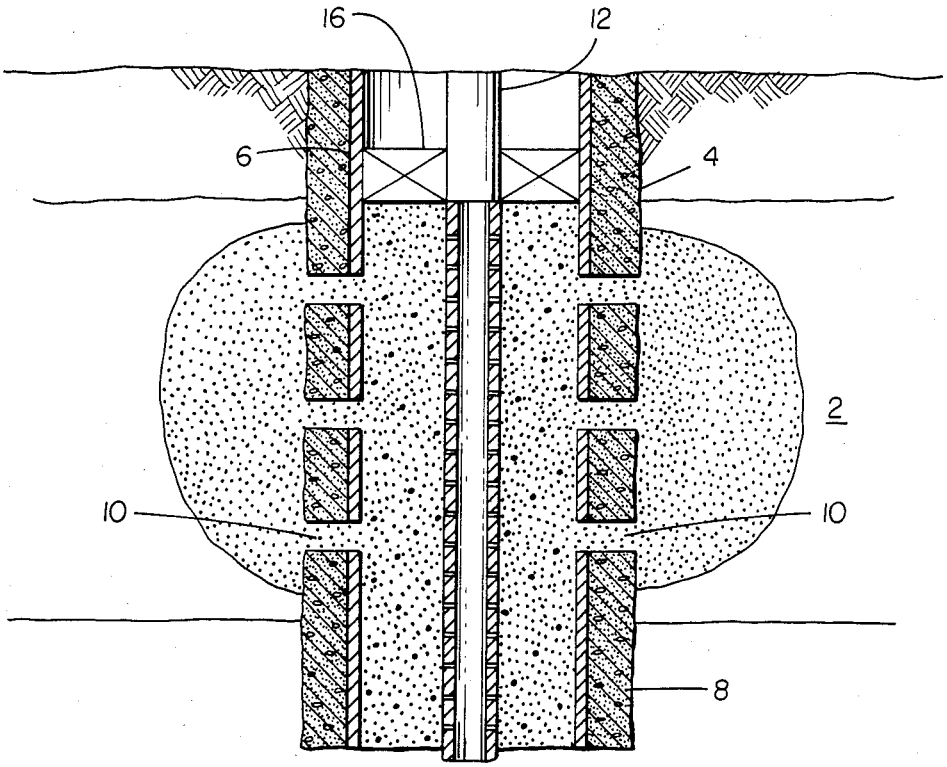
FIG. 2 is a schematic view of the formation showing an in-casing gravel pack and a gravel pack within the washed out portion of the formation or reservoir.

In the practice of this invention, as shown in FIG. 2, a well 4 has penetrated the subterranean formation 2. A cement sheath 8 surrounds casing 6. A packer 16 is run in on tubing and set in well 4 to isolate that portion of the well penetrating the formation 2 from the portion of the well there above. Said tubing is filled with an underbalanced completion fluid. Afterwards, a "through tubing" perforating gun is used to perforate the casing. A reliable gun such as Schlumberger's 2⅛ inch Enerjet can be used. A high pressure lubricator can also be used to allow perforating under pressure. Other methods of perforating the casing are discussed in U.S. Pat. No. 3,983,941 issued to Fitch on Oct. 5, 1976, and which is hereby incorporated by reference. The perforating gun is then removed from the tubing. If a lubricator has been used, the perforating gun can be removed through the lubricator. Afterwards, approximately 50 barrels of a fluid compatable with the formation such as KCl or NaCl brine, which is obtainable from various service companies is placed through the tubing. The purpose of this fluid is to condition the formation so as to be receptive to a chemical blocking agent.

Thereafter, a chemical blocking agent is introduced into the formation by said first tubing. The volume of said chemical blocking agent is determined based upon the extent of the perforated interval and the capacity of the formation area desired to be blocked. Chemical blocking agents suitable for this purpose are available from various service companies. Some of these blocking agents are Temblock blocking agents and Protect-O-Zone, which are obtainable from Halliburton Serivces and Dowell-Schlumberger, located in Duncan, Okla. and Tulsa, Okla., respectively. If the formation is overpressured, which means the reservoir pressure is greater than the hydrostatic pressure of water (0.433 psi/ft) standing in the wellbore, the volume of chemical blocking agent should be prepared from the high density brine. The chemical blocking agents can be any of a number of related materials including cross-linked fluids or high concentrations of guar or cellulose. These materials will be discussed later. As is anticipated, a relatively small amount, usually less than about 50 barrels, of this fluid is required to isolate the perforated interval and the washed out portion of the formation surrounding well 4 as shown in FIG. 2. After about 2 to about 4 hours, the chemical blocking agent has set up and solidified. Subsequently, a high density brine of about 10 weight percent sodium chloride to about 28 weight percent sodium chloride is injected into said first tubing on top of the solidified chemical blocking agent. Placement of the high density brine solution on top of the solidified chemical blocking agent allows the first tubing or "work string" to be removed from the well 4. Upon solidification, the chemical blocking agent also protects the formation 2, as shown in FIG. 2, and the washed out area surrounding the wellbore 4, while forming a solidified plug within well 4.

Once said first tubing or "work string" has been removed from well 4, a production string having a slotted liner assembly 12 is placed into well 4 and penetrates the solidified chemical blocking agent. The slotted liner portion of production string 12 allows contact to be made through the perforations and into the washed out areas surrounding the wellbore for placement of a gravel pack. Thereafter, depending upon the composition of the solidified chemical blocking agent, said solidified blocking agent can be removed by either chemical or physical means.

In order to establish a gravel pack 10 as shown in FIG. 2, it is necessary to remove the solidified chemical blocking agent as discussed above, either by chemical or mechanical means. Upon removal of the solidified chemical blocking agent from the well 4, a gravel pack placement operation can begin. Gravel packing methods are known to those skilled in the art. A preferred consolidatable gravel pack method is disclosed by Friedman in U.S. Pat. No. 4,428,427 which issued on Jan. 31, 1984 and which is hereby incorporated by reference. This gravel packing operation immediately follows the removal of the solidified chemical blocking agent from said washed out portion of the formation surrounding the well and also removal of said chemical blocking agent from the core of well 4. A preferred method for the removal of the solidified chemical blocking agent from the formation, the washed out area surrounding the well 4, and within the well is to have a gel composition which liquefies within a specified period of time. In this manner, the chemical blocking agent is allowed to flow from the formation 2 into wellbore 4. Gel compositions which are suitable for use in this preferred embodiment will be discussed later.

After removing the solidified blocking agent from the washed out portion of said formation and the wellbore, a gravel pack 10 is placed within the well 4 and the washed out portion of the formation surrounding the well 4. The gravel pack which is placed into the washed out area and in the well around the slotted portion of tubing 12 is sufficient to prevent fines migration from the formation into the well. Placement of said gravel pack consolidates the sand within the formation and allows fluid communication between the formation and said wellbore for the production of hydrocarbonaceous fluids.

Figure 1:
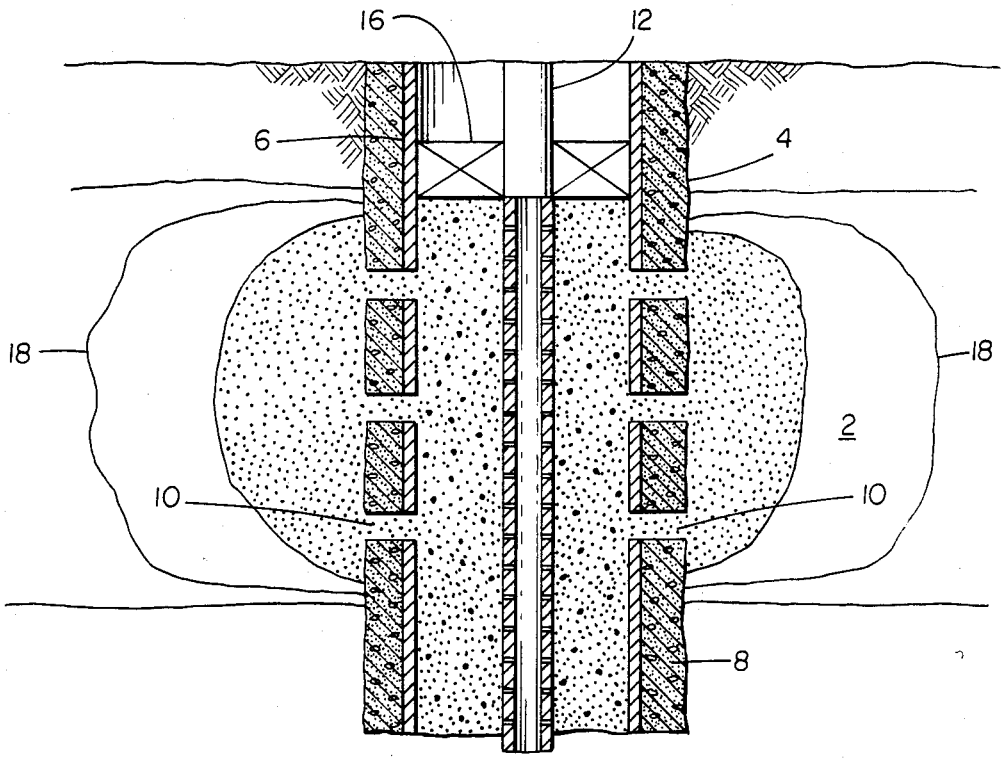
FIG. 1 is a schematic view of the formation showing an invaded zone where workover and chemical fluids have entered the formation.

FIG. 1 shows damage resultant from placement of a gravel pack without benefit of this invention. As shown in FIG. 1, the "invaded" zone 18 has resulted because of the placement or injection of consolidation fluids, workover fluids and chemicals ("intrusive fluids") which have penetrated the formation zone in a manner to cause a blocking of the pores within the formation. In the practice of the method disclosed above, and as is shown in FIG. 2, said "invaded" zone is reduced thereby minimizing damage to the formation by said fluids.

Chemical blocking agents which are preferred for utilization in the practice of this invention include solidifiable gel mixtures. Solidifiable gel mixtures which can work in the present invention are selected to withstand conditions encountered in the formation. As will be understood by those skilled in the art, the composition of the mixture can be varied to obtain the desired rigidity in the gel composition. One method of making a suitable, compatible mixture is discussed in U.S. Pat. No. 4,333,461 which issued to Muller on June 8, 1982 and which is hereby incorporated by reference. The stability and rigidity of the selected gel will depend upon the physical and chemical characteristics of the gel which are dictated by conditions in the formation. As is known to those skilled in the art, the solidified gel should be generally of a stability and rigidity which will absorb the heat and pressures encountered in a formation. Generally, the pressures encountered in a formation will vary from about 1,000 psig to about 20,000 psig. Heat encountered in a formation will generally vary from about 60° to about 450° F.

Often, it will be necessary to increase the density of the pumpable solidifiable gel to obtain the desired stability and rigidity. To accomplish this, a solid non-reactant material can be added to the pumpable gel mixture. Calcium carbonate is a preferred non-reacting solid material.

Other gel mixtures can be used to obtain the desired stability and rigidity. A preferred mixture used to obtain the desired stability and rigidity, for example, is a mixture of hydropropyl guar cross-linked with transitional metals and ions thereof. The purpose of the transitional metal ions is to provide increased strength, stability and rigidity for the solidifiable gel.

Hydropropyl guar is placed into the gel mixture in an amount of from about 0.70 to about 10.0 weight percent of said mixture. As is preferred, hydropropyl guar is placed in said mixture in about 7.2 percent by weight of said mixture.

Metallic ions which can be used in the pumpable gel mixture include titanium, zirconium, chromium, antimony and aluminum. The concentration of these transitional metals in the pumpable solidifiable gel fluid will of course vary depending upon the requirements for the particular formation being treated. Although the exact amounts of the metals required will vary depending on the particular application, it is anticipated that the metals should be included within the pumpable gel fluid in amounts of from about 0.005 weight percent to about 0.50 weight percent, preferably about 0.01 weight percent of said fluid.

It is often desirable to have a solidified gel which will withstand a formation temperature range from about 300° F. to about 450° F. for from about 0.5 of a day to about 4 days. These solidified gels will be self destructive after about 0.5 of a day to about 4 days. While the gel is solidifying, preparation can be taken for the gravel packing step. A thermally stable gel can be obtained by mixing into the pumpable gel mixture a chemical known as an oxygen scavenger (such as sodium thiosulfate or short chain alcohols such as methanol, ethanol, and isopropanol), preferably sodium thiosulfate. The concentration of the oxygen scavenger utilized, of course, will depend upon the thermal stability desired to be obtained for the solidified gel in the formation. However, as preferred, it is anticipated that the concentration of the oxygen scavenger in the pumpable gel mixture will be from about 0.10 percent by weight to about 0.75 percent by weight, preferably 0.50 percent by weight.

In formations where temperatures are lower, a gel breaker can be placed in the solidifiable gel prior to injecting the gel into the formation. This gel breaker, included in the gel mixture, is selected from a group of chemicals which can break down the solid gel at temperatures of less than from about 60° F. to about 250° F. Generally this breakdown will occur within from about 2 hours to about 24 hours depending upon type and concentration of breaker added. Chemicals satisfactory for use as gel breakers, and which are incorporated into the gel mixture, include enzymes and oxidizing agents, suitable for breaking down the solid gel (such as sodium persulfate). Other gel breakers sufficient for this purpose are discussed in U.S. Pat. No. 4,265,311 issued to Ely on May 5, 1981, which is hereby incorporated by reference. These chemicals are readily available from chemical suppliers and with the exception of enzyme breakers are sold under their chemical names. Enzyme breakers can be obtained from oil field service companies. The concentration of the gel breaker incorporated into the gel mixture will vary from about 0.01 weight percent to about 0.10 weight percent, preferably about 0.05 weight percent of the gel mixture. Upon cooling to a temperature of from about 60° F. to about 150° F., the gel breaker will breakdown the solid gel causing it to liquify and flow from the formation.

In one example of the practice of this invention, a slurry is formed with 1,000 gallons of water. This slurry comprises about 40 pounds of base gel such as hydroxypropyl guar gum which forms a gel in the water. To this mixture is added about 600 pounds of chemically treated hydroxypropyl guar gum which has delayed hydration or thickening qualities. Approximately 20 pounds of a buffer or catalyst suitable to obtain the desired pH and reaction time is added to this mixture. A sodium pyrophosphate buffer is suitable for this purpose. Cross-linking agents, such as borates and chromates, are then added in an amount of about 20 pounds. Sodium tetra-borate is suitable for this purpose and preferred. Forty-two pounds of sodium thiosulfate, an oxygen scavenger, is then added to the mixture. This gel mixture is pumped into the casing of well 4 as shown in FIG. 2 and also into the washed out portion of the formation. After solidification of the mixture, any undesired solidified gel in the wellbore 12 can be removed by contacting it with 15 volume percent of hydrochloric acid in an amount sufficient to solubilize said gel.

As is understood by those skilled in the art, the composition of a selected gel will depend upon many variables including formation conditions. The above example is mentioned as one possible variation among many others.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

I claim:

1. A method for minimizing formation damage caused by intrusive fluids prior to a gravel packing operation in loosely consolidated formations penetrated by at least one well comprising:

(a) filling the casing of said well with an underbalanced completion fluid;
(b) placing within said well a removable packer capable of isolating the space between said casing and the formation from the downhole well pressure;
(c) setting through said packer a first tubing suitable for perforating and stabilizing the flow of fluids into said well;
(d) perforating said casing;
(e) introducing a blocking agent into said formation via the perforations which agent upon solidification is sufficient to minimize formation damage by avoiding the introduction of formation fluids;
(f) causing said blocking agent to solidify while forming a solidified plug within said well and a solid mass within the adjacent washed out portion of said formation;
(g) removing said first tubing from said well;
(h) placing within said well a second tubing having a slotted portion therein sufficient to allow gravel packing of the well and the formation;
(i) removing said solidified plug from said wellbore along with solidified gel from said washed-out portion of the formation; and
(j) placing a gravel pack within said well and said washed out portion of the formation via said second tubing which consolidates said formation.

2. The method as recited in claim 1 where in step (e) said blocking agent comprises a solidifiable gel mixture which solidifies after about 2 to about 4 hours.

3. The method as recited in claim 1 where in step (e) said blocking agent comprises a solidifiable gel mixture which forms a solid sufficient to withstand pressures of from about 1,000 psig to about 20,000 psig.

4. The method as recited in claim 1 where in step (e) said blocking agent comprises a solidifiable gel mixture which forms a solid able to withstand temperatures greater than about 450° F.

5. The method as recited in claim 1 where in step (e) said blocking agent comprises a solidifiable gel mixture which becomes solid and is made thermally stable for temperatures of from about 350° F. to about 450° F. for from about 0.5 of a day to about 4 days.

6. The method as recited in claim 1 where in step (e) said blocking agent comprises a solidifiable gel mixture into which a gel breaker is added in amounts sufficient to breakdown the subsequently formed solid gel at temperatures of less than from about 60° F. to about 250° F. within from about 2 hours to about 24 hours.

7. The method as recited in claim 1 where in step (e) said blocking agent comprises a solidifiable gel mixture into which an oxygen scavenger is placed in a concentration of about 0.10 to about 0.75 weight percent of said mixture, and said oxygen scavenger is a material selected from the group consisting of sodium thiosulfate and a short chain alcohol.

8. The method as recited in claim 1 where in step (e) said blocking agent comprises a solidifiable gel mixture which contains a gel breaker capable of breaking down a subsequently formed solid gel at temperatures less than from about 60° F. to about 250° F. within from about 2 to about 24 hours.

9. The method as recited in claim 1 where in step (e) said blocking agent comprises a solidifiable gel mixture which contains a gel breaker capable of breaking down said subsequently formed solid gel where said gel breaker is a material selected from the group consisting of an enzyme and an oxidizing agent.

10. A method for minimizing formation damage caused by intrusive fluids during a gravel packing operation in loosely consolidated hydrocarbonaceous bearing formations penetrated by at least one well comprising:
(a) filling the casing of said well with an underbalanced completion fluid;
(b) placing within said well a removable packer capable of isolating the space between said casing and the formation from the downhole well pressure;
(c) setting through said packer a first tubing suitable for perforating and stabilizing the flow of fluids into said well;
(d) perforating said casing;
(e) introducing a blocking agent into said formation via the perforations which agent upon solidification is sufficient to minimize formation damage by avoiding the introduction of formation fluids:
(f) causing said blocking agent to solidify and consolidate the formation while forming a solidified plug within said well and a solid mass within the adjacent formation or washed out portion of said formation;
(g) removing said first tubing from said well;
(h) placing within said well a second tubing having a slotted portion therein sufficient to allow gravel packing of the well and the washed out portion of the formation;
(i) removing said solidified plug from said wellbore along with solidified gel from said washed-out portion of the formation;
(j) placing a gravel pack within said well and said washed out portion of the formation via said second tubing which consolidates said formation; and
(k) establishing fluid communication between said formation and said well sufficient to produce hydrocarbonaceous fluids from said well.

11. The method as recited in claim 10 where in step (e) said blocking agent comprises a solidifiable gel mixture which solidifies after about 2 to about 4 hours.

12. The method as recited in claim 10 where in step (e) said blocking agent comprises a solidifiable gel mixture which forms a solid sufficient to withstand pressures of from about 1,000 psig to about 20,000 psig.

13. The method as recited in claim 10 where in step (e) said blocking agent comprises a solidifiable gel mixture which forms a solid able to withstand temperatures greater than about 1,000° F.

14. The method as recited in claim 10 where in step (e) said blocking agent comprises a solidifiable gel mixture which becomes solid and is made thermally stable for temperatures of from about 350° F. to about 450° F. for from about 0.5 of a day to about 4 days.

15. The method as recited in claim 10 where in step (e) said blocking agent comprises a solidifiable gel mixture into which a gel breaker is added in amounts sufficient to breakdown the subsequently formed solid gel at temperatures of less than from about 60° F. to about 250° F. within from about 2 hours to about 24 hours.

16. The method as recited in claim 10 where in step (e) said blocking agent comprises a solidifiable gel mixture into which an oxygen scavenger is placed in a concentration of about 0.10 to about 0.75 weight percent of said mixture, and said oxygen scavenger is a material selected from the group consisting of sodium thiosulfate and a short chain alcohol.

17. The method as recited in claim 10 where in step (e) said blocking agent comprises a solidifiable gel mixture which contains a gel breaker capable of breaking down a subsequently formed solid gel at temperatures less than from about 60° F. to about 250° F. within from about 2 to about 24 hours.

18. The method as recited in claim 10 where in step (e) said blocking agent comprises a solidifiable gel mixture which contains a gel breaker capable of breaking down said subsequently formed solid gel where said gel breaker is a material selected from the group consisting of an enzyme and an oxidizing agent.

19. A method for minimizing formation damage caused by intrusive fluids during a gravel packing operation in loosely consolidated formations penetrated by at least one well comprising:

(a) filling the casing of said well with an underbalanced completion fluid;

(b) placing within said well a removable packer capable of isolating the space between said casing and the formation from the downhole well pressure;

(c) setting through said packer a first tubing suitable for perforating and stabilizing the flow of fluids into said well;

(d) perforating said casing;

(e) introducing a blocking agent into said formation via said perforations which agent upon solidification is removable by hydrochloric acid of a strength of about 15 volume percent or by physical means;

(f) causing said blocking agent to solidify while forming a solidified plug within said well and a solid mass within the adjacent washed out portion of said formation;

(g) removing said first tubing from said well;

(h) placing within said well a second tubing having a slotted portion therein sufficient to allow gravel packing of the well and the formation;

(i) removing said solidified plug from said wellbore along with solidified gel from said washed-out portion of the formation; and (j) placing a gravel pack within said well and said washed out portion of the formation via said second tubing which consolidates said formation.

* * * * *